United States Patent [19]

Claassen

[11] Patent Number: 4,919,072

[45] Date of Patent: Apr. 24, 1990

[54] DEVICE FOR APPLYING A FLOWABLE COATING MASS

[75] Inventor: Henning J. Claassen, Lüneburg, Fed. Rep. of Germany

[73] Assignee: Nordson Corporation, Westlake, Ohio

[21] Appl. No.: 307,224

[22] Filed: Feb. 6, 1989

Related U.S. Application Data

[63] Continuation of Ser. No. 938,299, Dec. 5, 1986, abandoned.

[30] Foreign Application Priority Data

Dec. 9, 1985 [DE] Fed. Rep. of Germany ..... 3543485

[51] Int. Cl.[5] ..... B05C 11/00

[52] U.S. Cl. ..... 118/666; 118/410; 361/391; 403/331; 403/324

[58] Field of Search ..... 118/202, 410, 411, 666, 118/667, 688; 364/706, 709.1; 211/94.5; 403/331, 324, 327; 361/391; 439/296

[56] References Cited

U.S. PATENT DOCUMENTS

| | | | |
|---|---|---|---|
| 2,486,764 | 11/1949 | Singer | 361/391 |
| 2,566,064 | 8/1951 | Keim | 361/391 X |
| 2,583,586 | 1/1952 | Miller | 361/391 |
| 2,880,379 | 3/1959 | Stoddart et al. | 361/391 |
| 3,078,824 | 2/1963 | Bechle | 118/410 |
| 3,277,868 | 10/1966 | Lockwood et al. | 118/410 |
| 3,289,044 | 11/1966 | Ginsberg | 361/391 |
| 3,307,080 | 2/1967 | Cody | 361/391 |
| 3,352,279 | 11/1967 | Lockwood | 118/258 |
| 4,059,714 | 11/1977 | Scholl et al. | 428/317.5 |
| 4,153,937 | 5/1979 | Poland | 364/706 |

OTHER PUBLICATIONS

PTO—88—0667, English Translation of Trankner Reference, 2-88.

Trankner; Taschenbuch Maschinenbau (Pocket Book Edition of Machine Construction); Published by Veb Verlag Technik, Berlin (East Germany); vol. 3, Part 1; 1978; pp. 523-527.

*Primary Examiner*—Shrive Beck
*Assistant Examiner*—Alain Bashore
*Attorney, Agent, or Firm*—Armstrong, Nikaido, Marmelstein, Kubovcik & Murray

[57] ABSTRACT

An application apparatus for applying a flowable coating mass, in particular a hot-melt adhesive, to the surface of a substrate comprises a housing for a reservoir for the coating mass, a heating means for heating the coating mass and a conveying means for supplying the heated coating mass via a line from the reservoir to an application head. As a separate unit with a closed housing control means is provided which guided on rails is detachably secured to the housing. The electrical control means is connected via an arrestable electrical plug-type connection to the housing.

11 Claims, 1 Drawing Sheet

DEVICE FOR APPLYING A FLOWABLE COATING MASS

This is a continuation of application Ser. No. 938,299, filed Dec. 5, 1986, now abandoned.

BACKGROUND OF THE INVENTION

1. Field of the Invention

The invention relates to a device for applying a flowable coating mass, in particular a hot-melt adhesive, to the surface of a substrate. The device comprises a housing, a heating means for heating the coating mass and a control means. 2. Description of the Prior Art In the usual devices for applying flowable coating masses the electrical control means is integrated into the housing. In the event of a defect in the electrical control means, the entire device must be shut down and repaired. Such disorders are, however, relatively frequent because the heated coating mass has a relatively high temperature which in turn, affects the electrical control means since the heated coating mass is a short distance away.

It has therefore already been proposed to construct the electrical control mans as a separate unit and, for example, place it on the housing of the device. However, there is then the danger that the electrical control means will fall off due to vibration. In addition, excessive heating of the electrical control means can still occur.

SUMMARY OF THE INVENTION

Therefore, the invention has as its object to provide a device for applying a flowable coating mass, in particular a hot-melt adhesive, to the surface of a substrate, with which the aforementioned disadvantages are eliminated.

More particularly, a device is to be provided in which an exchange of the electrical control means is possible without any problems and without any risk of damaging the sensitive electronic components of the electrical control means.

The invention therefore proposes a device for applying a flowable coating mass, in particular a hot-melt adhesive, to the surface of a substrate comprising a housing, a reservoir for the coating mass in the housing, a heating means for heating the coating mass, a conveying means for supplying the heated coating mass via a line from the reservoir to an application head, and an electrical control means. Th electrical control means is guided on rails, and is secured detachably to the housing. The electrical control means is connected via an arrestable electrical plug-type connector to the housing.

Expedient embodiments are defined by the features of the subsidiary claims.

The advantages achieved with the invention are due to the fact that the electrical control means, although constructed as a separate unit and accommodated in a separate, closed housing, can be coupled to the housing of the device in such a manner that the control means cannot become detached. For this purpose the housing of the electrical control means is guided detachably on rails which are provided on the housing of the device.

When the electrical control means is defective it can be replaced by a unit which is in order and consequently an additional electrical control means is best kept in readiness for such a case.

The coupling between the electrical control means and the housing takes place via an arrestable electrical plug-type connector. Even in the event of an operating error, it is practically impossible for the electrical control means to become detached from the housing and drop onto the floor.

The electrical control means is detached by pushing on the rails somewhat to the front and then raised through a gap in the rail guide; thereafter the electrical plug-type connector is released so that the defective electrical control means can be removed and replaced by a new one.

For asthetic reasons, and to simplify handling, the housing of the electrical control means, seen from the side, should have substantially the form of a triangle. The control elements, that is buttons, rotary knobs or displays, are disposed on an inclined face of the triangle.

The electrical control means should be adapted to the housing so that an air gap is formed between their respective surfaces which serves as thermal insulation and prevents the electrical control means from being over heated.

According to a preferred embodiment the lines for delivering the heated coating mass led outwardly at the front side of the housing of the device, i.e. at the side at which the electrical control means is disposed; this simplifies both the line path and the operation because this application device can now be set up directly on the transport means for the substrate to be coated.

BRIEF DESCRIPTION OF THE DRAWINGS

The invention will be described in detail hereinafter with the help of an example of embodiment with reference to the accompany diagrammatic drawings, wherein.

DESCRIPTION OF THE PREFERRED EMBODIMENT

Figure 2:
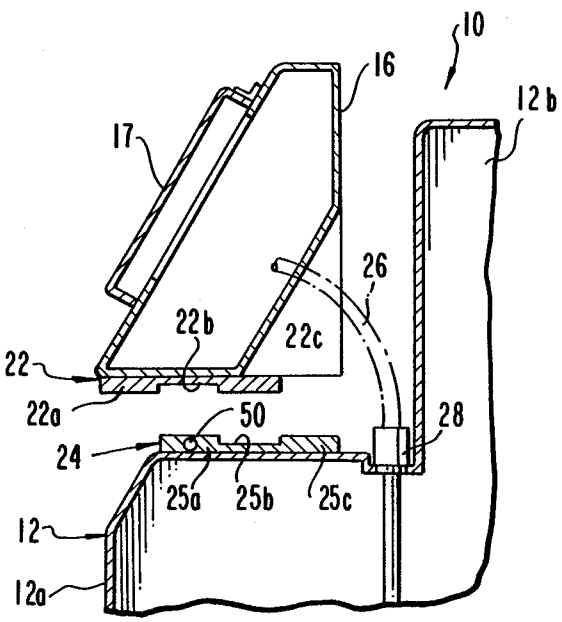
FIG. 2 is a side sectional elevation of this device with raised electrical control means, seen from the side along section I—I in FIG. 1.
Figure 1:
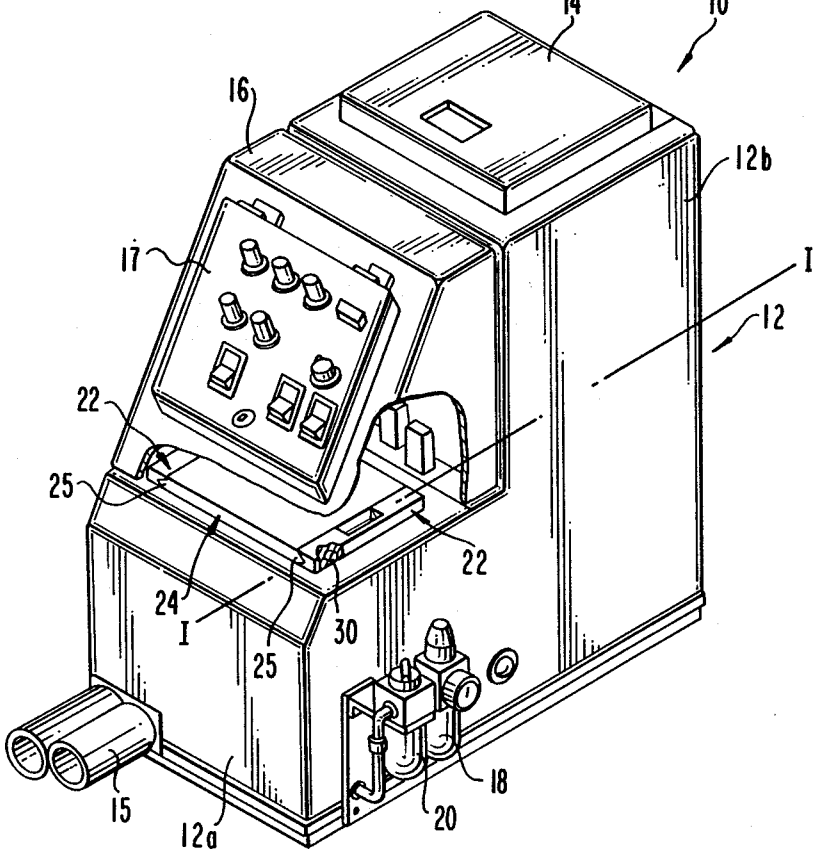
FIG. 1 is a perspective view of a device for heating an application or coating composition, the electrical control means being shown partially cut away.

The device for heating a coating mass is by the reference numeral 10 in FIGS. 1 and 2 generally indicated. In particular, a hot-melt adhesive is heated until it reaches its flowable state. The device contains a box-shaped housing 12 which is constructed as a thermal protective hood and comprises a lower part 12*a* and a column-shaped upper part 12*b* so that on the left side of the housing 12, according to the illustration in FIGS. 1 and 2, a rectangular cut-out results in a lateral section. At the upper side of the upper part 12*b* there is a cover 14 for the filling opening for the hot-melt adhesive.

In the housing 12 the usual components (not shown in detail) are provided. That is, a reservoir for the hot-melt adhesive, a heating means for heating the hot-melt adhesive in the reservoir, and a metering pump serving as conveying means for withdrawing the heated flowable hot-melt adhesive from the reservoir are provided. Through lines 15, which are provided on the left side of the housing 12 in accordance with the illustration in the Figures, the heated hot-melt adhesive is conveyed by means of the metering pump from the reservoir to the application head. The application head applies the heated flowable hot-melt adhesive to the surface of a substrate either as a thin uniform layer or in a spraying operation.

On the right side of the housing 12, according to the illustration of FIG. 1, a manometer 18 and a maintenance unit with water separator 20 are provided.

In the cut-out of the housing 12, an electrical control means is disposed in a suitable self-contained housing 16 which has an inclined front wall, i.e. the housing 16 has, in side elevation, a substantially triangular form except for a rear cut-away region resulting from a bevelling of the rear wall as apparent from FIG. 2.

On the inclined front side thereof is a sort of "switch panel 17" with various schematically indicated control and display elements such as buttons, rotary knobs, scales, etc.

At the bottom of the cut-out, i.e. on the free upper side of the lower part 12*a* of the housing, a plate 24 is disposed whose lateral edges are provided with pointed edges 25. These pointed edges do not extend over the entire length of the plate 24 but are formed only at the front or rear end of the edge of the plate 24 while an intermediate region is cut away, as indicated in FIG. 2, i.e. each edge 25 has a front portion 25*a*, the cut-out 25*b* and a rear portion 25*c*.

At the lower side of the housing 16 of the electrical control means there are two parallel rails 22 which at their opposing side faces are provided with acute-angled grooves of triangular cross-section. The form of these grooves corresponds to the form of the pointed edges 25 of the plate 24 so that the rails 22 and thus the housing 16 of the electrical control means are guided in horizontal direction on the blade-like edges 25 of the plate 24.

The rails 22 have in their center region in each case a recess 22*b* whose length corresponds to the length of the rear portions 25*c* of the blade-like edges 25 of the plate 24. Each rail 22 consists of a front piece 22*a*, a recess or cut-out 22*b* and a rear portion 22*c*.

In the housing 16 of the electrical control means, the control elements for the heating means, the electrical motor and the magnetic valve for supplying the heated hot-melt adhesive to the line 15 are accommodated.

The electrical connection between the electrical control means and the components to be controlled as accommodated in the housing 12 takes place via a cable 26 which is attached to the housing 12 with an arrestable electrical plug-type connector 28, for example a screw or bayonet connection.

Between the opposing faces of the housings 12 and 16 an air gap is formed which serves as thermal insulation, i.e. prevents excessive heating of the sensitive electronic components of the electrical control means.

If the electrical control means is to be replaced, for example, because of a defect, its housing 16 is pushed according to the illustration of FIGS. 1 and 2 on the rail guide to the left until the front region 22*a* of the rails 22 is free of the front portion 25*a* of the blade-like edges 24, the front portion 25*a* of the blade-like edges 25 lies in the cut-out 22*b* and the rear region 22*c* in the cut-out 25*b*. The housing 16 can now be raised upwardly as indicated in FIG. 2. The sole connection between the housing 16 and the housing 12 is then only the electrical lead 26 with the plug-type connector 28. This connection is stable enough however to hold the housing 16 should it become necessary.

If the electrical plug-type connector 28 is also detached, the housing 16 can be completely removed. Subsequently a new control means is inserted in that the rear rail piece 22*c* is introduced into the cut-out 25*b* in the side edges 25 of the plate 24 and thereafter the electrical control means is pushed to the rear, the rails 22 and the edges 25 of the plate 24 serving as a sort of dovetail guide until the position shown in FIG. 1 is reached and the housing 16 is reliably held.

An additional safety device preventing the electrical control means for dropping out of the rail guide is the spring loaded pin 30 which is indicated in FIG. 1, and which extends through a trough-shaped depression 50 in the edge 25 to be disposed resiliently in a lateral opening of the rail 22 and pressed outwardly by the blade-like edges 25. On withdrawal of the electrical control means, however, the pin 30 moves inwardly so that it is no longer held by the front piece 22*a* of the rail 22 in the outer position, i.e. on arrival of the cut-out 22*b*. In its inner position the pin 30 thus serves as stop for the rear rail piece 22*c*.

In the embodiment described so far the plate 24 is disposed on the housing 12 while the rails 22 are arranged on the housing 16 of the control means. However, fundamentally the converse arrangement is possible, i.e. the plate can be secured to the housing 16 of the control means and the rails 22 to the housing 12.

In both cases the spring pin 30 serves to locate the housing 16 of the control means in the working position and to prevent the housing 16 from slipping forwardly, for example, when such a device is transported.

For this purpose in the front portion of the element which is secured to the housing 16, i.e. in the embodiment according to FIGS. 1 and 2 at the front piece 22*a* of the right rail 22, a trough-shaped depression 50 is provided for receiving the spring pin 30. When the housing 16 is drawn forwardly the spring pin 30 slides out of the trough and thus permits lifting out or pulling forward of the housing 16 up to the front edge of the rear piece 22*c*. The housing 16 and thus the control means can now be removed without any problem.

I claim:

1. A housing for a device for applying a flowable coating mass to a surface of a substrate, comprising:

a first housing for housing the hot-melt adhesive;

an electrical control means for controllably heating said hot-melt adhesive in said first housing;

a closed housing for accommodating said electrical control means, said closed housing being releasably mounted on said first housing, an air gap being formed between said first housing and said closed housing;

a rail-like means for releasably mounting said closed housing on said first housing and for reducing heat transfer between said first housing and said closed housing; and an arrestable electric plug-like connection means for connecting said electrical control means to said first housing.

2. A housing for a device for applying a flowable coating mass to a surface of a substrate, comprising:

a first housing, forming a rectangular cut-out when viewed in lateral section, said first housing holding said hot-melt adhesive;

an electrical control means for controllably heating said hot-melt adhesive in said first housing;

a closed housing for accommodating said electrical control means, said closed housing being releasably mounted in said rectangular cut-out of said first housing, said closed housing being substantially triangular in form and having a rear cut-away region formed by a bevelled rear wall, an air gap being formed between said first housing and said closed housing;

a rail-like means for releasably mounting said closed housing on said first housing and for reducing heat transfer between said first housing and said closed housing; and an arrestable electric plug-type connection means for connecting said electrical control means to said first housing.

3. A housing for a device for applying a flowable coating mass comprising:

a first housing for housing said flowable coating mass;

a closed housing releasably supported on said first housing, an air gap being formed therebetween;

a detachment means for releasing said closed housing from said first housing and for reducing heat transfer between said first housing and said closed housing;

an electrical control means, accommodated in said closed housing, for heating said flowable coating mass; and an arrestable electric plug-type connector for connecting said electrical control means to said first housing.

4. A device according to claim 3, wherein said first housing is constructed as a heat-protection hood.

5. A device according to claim 3, wherein said closed housing in side elevation has a substantially triangular form.

6. A device according to claim 5, wherein at a lower side of said closed housing of the electrical control means, two rails are provided which extend parallel to each other and said rails comprise facing sharply tapered grooves for receiving acute-angled edges of a plate secured to said first housing.

7. A device according to claim 6, wherein said plate has a pin, which projects into the grooves of said rails and serves as a stop, said rails, having a recess.

8. A device according to claim 5, wherein a rear wall of the housing of the electrical control means is inclined and thereby forms a cavity for accommodating the arrestable electrical plug-type connector.

9. A device according to claim 3, wherein said electrical control means is detachable from a rail guide of said first housing.

10. A device according to claim 3, wherein the arrestable electrical plug-type connector is formed by a screw or bayonet connection.

11. A device according to claim 3, wherein lines for discharging a heated coating mass open at the front side of the first housing facing the electrical control means, into said housing.

* * * * *